US011753937B2

(12) United States Patent
Cheng et al.

(10) Patent No.: US 11,753,937 B2
(45) Date of Patent: Sep. 12, 2023

(54) ULTRA-LONG TUNNEL SEWAGE DISPOSAL, SEPARATION AND DRAINAGE STRUCTURE SUITABLE FOR COLD REGIONS

(71) Applicant: CCCC Second Highway Consultants Co., Ltd., Hubei (CN)

(72) Inventors: Yong Cheng, Wuhan (CN); Wenbo Peng, Wuhan (CN); Kang Gao, Wuhan (CN); Yilin Jian, Wuhan (CN); Cong Zheng, Wuhan (CN); Xiang Gao, Wuhan (CN); Zidong Song, Wuhan (CN); Xiaoxin Zou, Wuhan (CN)

(73) Assignee: CCCC Second Highway Consultants Co., Ltd., Hubei (CN)

( * ) Notice: Subject to any disclaimer, the term of this patent is extended or adjusted under 35 U.S.C. 154(b) by 0 days.

(21) Appl. No.: 17/426,407

(22) PCT Filed: Jun. 18, 2020

(86) PCT No.: PCT/CN2020/096735
§ 371 (c)(1),
(2) Date: Jun. 9, 2022

(87) PCT Pub. No.: WO2021/109537
PCT Pub. Date: Jun. 10, 2021

(65) Prior Publication Data

US 2022/0316337 A1 Oct. 6, 2022

(30) Foreign Application Priority Data

Dec. 4, 2019 (CN) ..... 201911229834.9

(51) Int. Cl.
*E21D 11/00* (2006.01)
*E21F 16/02* (2006.01)
*E21F 17/00* (2006.01)

(52) U.S. Cl.
CPC ..... *E21F 16/02* (2013.01); *E21F 17/00* (2013.01)

(58) Field of Classification Search
CPC ..... E21F 16/02; E21F 17/00; E21D 9/006; E21D 11/38; E21D 9/14; E21D 9/00;
(Continued)

(56) References Cited

U.S. PATENT DOCUMENTS 144,112 A * 10/1873 Knoll ..... E21D 11/102 405/150.1
360,655 A * 4/1887 Carpenter ..... E21F 17/103 405/154.1

(Continued)

FOREIGN PATENT DOCUMENTS

CN 101285397 A 10/2008
CN 207813651 U 9/2018

(Continued)

OTHER PUBLICATIONS

European Patent Office, English abstract for CN101285397A, printed on Jul. 16, 2021.

(Continued)

*Primary Examiner* — Edwin J Toledo-Duran
(74) *Attorney, Agent, or Firm* — CAHN & SAMUELS, LLP

(57) ABSTRACT

The invention discloses an ultra-long tunnel sewage disposal, separation and drainage structure suitable for cold regions, comprising: a tunnel portal section drainage structure and a tunnel body section drainage structure and an out-tunnel clear water ditch, an out-tunnel deep-buried ditch, an out-tunnel sewage ditch and a clear water tank; the tunnel portal section drainage structure comprises a central ditch and a side sewage ditch A, the central ditch is deeply buried in the position, lower than the freezing depth, of a tunnel (Continued)

portal section of the main tunnel, and the side sewage ditches A are arranged on both sides of the tunnel portal section of the main tunnel; the tunnel body section drainage structure comprises a side clear water ditch and a side sewage ditch B, and the side clear water ditch and the side sewage ditch B are arranged on both sides of the tunnel body section of the main tunnel. The structure has the advantages that separation and discharge treatment of clear water and sewage during tunnel construction and operation is realized, and high environmental requirements are met; the tunnel portal section and the tunnel body section are separately provided with a drainage structure, the heat preservation requirement of drainage in cold regions is met, and underground water can be effectively prevented from seeping into the tunnel to cause freezing disasters; the drainage capacity of the main tunnel is enhanced through assistance of the service tunnel, and super-large water drainage of the ultra-long tunnel is achieved.

9 Claims, 5 Drawing Sheets

(58) Field of Classification Search
CPC ..... E21D 9/001; E21D 9/002; E21D 9/003; E21D 9/004; E21D 9/005; E21D 9/008; E21D 9/01; E21D 9/02; E21D 9/03; E21D 9/04; E21D 9/06; E21D 9/0607; E21D 9/0609; E21D 9/0621; E21D 9/0635; E21D 9/0642; E21D 9/065; E21D 9/0657; E21D 9/0664; E21D 9/0671; E21D 9/0678; E21D 9/0685; E21D 9/0692; E21D 9/08; E21D 9/087; E21D 9/0873; E21D 9/0874; E21D 9/0875; E21D 9/0879; E21D 9/093; E21D 9/10; E21D 9/1006; E21D 9/1013; E21D 9/102; E21D 9/1026; E21D 9/1033; E21D 9/104; E21D 9/1046; E21D 9/1053; E21D 9/106; E21D 9/1066; E21D 9/1073; E21D 9/108; E21D 9/1086; E21D 9/1093; E21D 9/11; E21D 9/111; E21D 9/112; E21D 9/113; E21D 9/115; E21D 9/116; E21D 9/117; E21D 9/118; E21D 9/12; E21D 9/122; E21D 9/124; E21D 9/126; E21D 9/128; E21D 9/13; E21D 11/00; E21D 11/003; E21D 11/006; E21D 11/02; E21D 11/03; E21D 11/04; E21D 11/05; E21D 11/06; E21D 11/07; E21D 11/08; E21D 11/083; E21D 11/086; E21D 11/10; E21D 11/102; E21D 11/105; E21D 11/107; E21D 11/12; E21D 11/14; E21D 11/15; E21D 11/152; E21D 11/155; E21D 11/157; E21D 11/18; E21D 11/183; E21D 11/186; E21D 11/20; E21D 11/22; E21D 11/24; E21D 11/26; E21D 11/28; E21D 11/30; E21D 11/34; E21D 11/36; E21D 11/362; E21D 11/365; E21D 11/367; E21D 11/381; E21D 11/383; E21D 11/385; E21D 11/386; E21D 11/388; E21D 11/40; E21D 11/403; E21D 11/406; E21D 13/00; E21D 15/00; E21D 15/002; E21D 15/005; E21D 15/007; E21D 15/02; E21D 15/04; E21D 15/06; E21D 15/08; E21D 15/10; E21D 15/12; E21D 15/14; E21D 15/15; E21D 15/155; E21D 15/16; E21D 15/18; E21D 15/20; E21D 15/22; E21D 15/24; E21D 15/26; E21D 15/28; E21D 15/285; E21D 15/30; E21D 15/303; E21D 15/306; E21D 15/32; E21D 15/325; E21D 15/34; E21D 15/36; E21D 15/38; E21D 15/40; E21D 15/42; E21D 15/43; E21D 15/435; E21D 15/44; E21D 15/445; E21D 15/45; E21D 15/46; E21D 15/465; E21D 15/48; E21D 15/483; E21D 15/486; E21D 15/50; E21D 15/502; E21D 15/51; E21D 15/512; E21D 15/515; E21D 15/517; E21D 15/52; E21D 15/523; E21D 15/526; E21D 15/54; E21D 15/545; E21D 15/55; E21D 15/56; E21D 15/563; E21D 15/566; E21D 15/58; E21D 15/581; E21D 15/5813; E21D 15/587; E21D 15/5817; E21D 15/584; E21D 15/585; E21D 15/586; E21D 15/588; E21D 15/589; E21D 15/60; E21D 15/603; E21D 15/606

See application file for complete search history.

(56) References Cited

U.S. PATENT DOCUMENTS

| | | | | | |
|---|---|---|---|---|---|
| 432,615 | A * | 7/1890 | Henning | B61B 13/10 | 104/138.1 |
| 466,046 | A * | 12/1891 | Reno | E21D 9/06 | 299/33 |
| 468,282 | A * | 2/1892 | Gribble | E21D 9/005 | 405/149 |
| 553,799 | A * | 1/1896 | Wood | B60M 1/307 | 191/23 R |
| 558,094 | A * | 4/1896 | Moxham | E21D 11/102 | 405/150.1 |
| 620,101 | A * | 2/1899 | Carpenter | E21D 9/005 | 405/138 |
| 671,686 | A * | 4/1901 | Bergeron | E21F 17/103 | 404/1 |
| 723,307 | A * | 3/1903 | Reno | E21D 9/0879 | 405/146 |
| 736,560 | A * | 8/1903 | Sooysmith | E21D 9/00 | 405/139 |
| 804,437 | A * | 11/1905 | See | E21D 9/00 | 405/139 |
| 836,215 | A * | 11/1906 | Reno | E21D 9/005 | 405/138 |
| 852,995 | A * | 5/1907 | Blackman | E21F 1/003 | 454/167 |
| 1,003,847 | A * | 9/1911 | Witthoefft | E21D 11/102 | 425/63 |
| 1,701,817 | A * | 2/1929 | Meier | E21D 11/00 | 285/398 |
| 2,067,493 | A * | 1/1937 | Kinzie | E21D 11/10 | 405/150.1 |
| 2,333,826 | A * | 11/1943 | Smith | E04B 1/68 | 52/742.16 |
| 2,841,303 | A * | 7/1958 | Washabaugh | E21D 11/40 | 405/138 |
| 3,436,919 | A * | 4/1969 | Shock | F17C 3/005 | 405/56 |
| 3,767,263 | A * | 10/1973 | Gootee | E21D 9/008 | 299/56 |
| 3,954,064 | A * | 5/1976 | Minovitch | H01F 7/0236 | 104/130.02 |
| 3,996,751 | A * | 12/1976 | Hallenius | E21D 13/00 | 376/273 |
| 4,012,916 | A * | 3/1977 | Jutte | E21D 9/0692 | 405/141 |
| 5,722,800 | A * | 3/1998 | Esters | E21D 9/001 | 405/36 |
| 5,879,057 | A * | 3/1999 | Schwoebel | E21B 43/292 | 299/56 |
| 10,364,564 | B2 * | 7/2019 | Liu | E02B 3/04 | |

(56) References Cited

U.S. PATENT DOCUMENTS

| | | | | |
|---|---|---|---|---|
| 2006/0165489 | A1* | 7/2006 | Seo | E21F 16/02 405/150.1 |
| 2007/0077125 | A1* | 4/2007 | Kadrnoska | F16L 3/223 405/183.5 |
| 2012/0045314 | A1* | 2/2012 | Mauro | F03D 9/255 415/121.3 |
| 2012/0099927 | A1* | 4/2012 | Dos Santos | E03F 3/046 405/118 |
| 2015/0125215 | A1* | 5/2015 | Dalegarden | E21F 16/02 405/152 |
| 2018/0283174 | A1* | 10/2018 | Warren | E21D 11/383 |
| 2019/0161954 | A1* | 5/2019 | Liu | E02B 5/02 |
| 2019/0203887 | A1* | 7/2019 | Young | F17D 5/02 |
| 2021/0222495 | A1* | 7/2021 | Valiante | E21B 7/18 |

FOREIGN PATENT DOCUMENTS

| | | | |
|---|---|---|---|
| CN | 208168933 | U | 11/2018 |
| CN | 208502838 | U | 2/2019 |
| CN | 109611148 | A | 4/2019 |
| KR | 10-2011-0004168 | A | 1/2011 |

OTHER PUBLICATIONS

European Patent Office, English abstract for CN207813651U, printed on Jul. 16, 2021.

European Patent Office, machine-generated English abstract for CN208502838U, printed on Jul. 28, 2021.

European Patent Office, English abstract for CN208168933U, printed on Jul. 16, 2021.

European Patent Office, English abstract for CN109611148A, printed on Jul. 16, 2021.

European Patent Office, English abstract for KR2011-0004168A, printed on Jul. 16, 2021.

China National Intellectual Property Administration, International Search Report for Application No. PCT/CN2020/096735, dated Sep. 17, 2020, pp. 1-5.

China National Intellectual Property Administration, Written Opinion for Application No. PCT/CN2020/096735, dated Sep. 17, 2020, pp. 1-4.

Su, Hang et al., "Waterproof and Drainage and Thermal Insulation Design of Highway Tunnels in High-Altitude Cold Region", Tianjin Construction Science and Technology, vol. 28, No. 6, Dec. 31, 2018), pp. 72-75.

* cited by examiner

ULTRA-LONG TUNNEL SEWAGE DISPOSAL, SEPARATION AND DRAINAGE STRUCTURE SUITABLE FOR COLD REGIONS

FIELD OF THE INVENTION

The present invention relates to the technical field of tunnels and underground engineering, in particular to an ultra-long tunnel sewage disposal, separation and drainage structure suitable for cold regions.

BACKGROUND OF THE INVENTION

Tunnel drainage is related to the normal advancement and safety of tunnel construction and operation. The "Specifications for Design of Highway Tunnels" stipulates: "attention should be paid to protecting the natural environment when taking waterproof and drainage measures for tunnels" and "a longitudinal drainage system should be installed inside the tunnel according to the principle of separate drainage of groundwater, operating and cleaning sewage and fire sewage".

The tunnel sewage comprises construction wastewater, operating and cleaning sewage and fire sewage. In areas with high environmental requirements, the sewage is not allowed to be directly drained, but must be reused or drained in other places after treatment, therefore, the drainage structure inside the tunnel requires separate trenches to drain the sewage. For extra-long and ultra-long tunnels, the volume of the sewage is large, so a stronger sewage discharge treatment system is required to meet the requirements.

Surrounding rock groundwater is generally clean, and there are two main ways to drain the groundwater: lining drainage and bottom drainage of pavement structure. For tunnel drainage in cold regions, it is advisable to set up a deep-buried central ditch in the areas where groundwater may freeze, but for the extra-long and super-long tunnels, the deep-buried central ditch is difficult to construct, inconvenient to maintain and repair, moreover, the extra-long and ultra-long tunnels span a large geological area and the overall water volume of the tunnels is large, which requires the tunnel to have a strong drainage capacity. The drainage of the main tunnel is limited by a section and a longitudinal slope, the drainage capacity is thus limited.

SUMMARY OF THE INVENTION

One of the purposes of the present invention is to provide an ultra-long tunnel sewage disposal, separation and drainage structure suitable for cold regions in view of the existing technical situation, which realizes separation and discharge treatment of clear water and sewage during tunnel construction and operation, and meets high environmental requirements.

The second purpose of the present invention is to provide an ultra-long tunnel sewage disposal, separation and drainage structure suitable for cold regions in view of the existing technical situation, the drainage structure is separately arranged at a tunnel portal section and a tunnel body section, which meets the thermal insulation requirements of drainage in cold regions, and can effectively prevent groundwater from seeping into the tunnel to cause freezing disasters.

The third purpose of the present invention is to provide an ultra-long tunnel sewage disposal, separation and drainage structure suitable for cold regions in view of the existing technical situation, a service tunnel is used to assist in enhancing drainage capacity of a main tunnel, which realizes the ultra-large water discharge of the ultra-long tunnel.

In order to achieve the above purposes, the present invention adopts the following technical solution.

An ultra-long tunnel sewage disposal, separation and drainage structure suitable for cold regions, comprising: a tunnel portal section drainage structure and a tunnel body section drainage structure arranged on the inside of a main tunnel and an out-tunnel clear water ditch, an out-tunnel deep-buried ditch, an out-tunnel sewage ditch and a clear water tank arranged on the outside of the main tunnel; wherein the tunnel portal section drainage structure comprises a central ditch configured to drain clear water and a side sewage ditch A configured to drain sewage; wherein the central ditch is deeply buried in the position, lower than the freezing depth, of the tunnel portal section of the main tunnel; one end of the central ditch at the inside of the main tunnel is blocked, and the other end at the outside of the main tunnel is connected to the out-tunnel clear water ditch through a water drop well; a longitudinal drainage pipe in a tunnel lining of the tunnel portal section of the main tunnel is connected to the central ditch through a transverse aqueduct A, the transverse aqueduct A is arranged at the bottom of an invert, and the side sewage ditches A are arranged on both sides of the tunnel portal section of the main tunnel; wherein the tunnel body section drainage structure comprises a side clear water ditch configured to drain the clear water and a side sewage ditch B configured to drain the sewage; wherein the side clear water ditches and the side sewage ditches B are arranged on both sides of the tunnel body section of the main tunnel, the side clear water ditch is connected to a service tunnel drainage channel through a transverse water diversion ditch, the out-tunnel clear water ditch and the service tunnel drainage channel merge into the out-tunnel deep-buried ditch, the longitudinal drainage pipe in the tunnel lining of the tunnel body section of the main tunnel is connected to the side clear water ditch through a transverse aqueduct B, and the side sewage ditches B on both sides of the tunnel body section of the main tunnel are longitudinally connected to the side sewage ditches A on both sides of the tunnel portal section of the main tunnel and merge into the clear water tank through the out-tunnel sewage ditch.

Further, both the tunnel portal section drainage structure and the tunnel body section drainage structure further comprise a pavement drainage structure; the pavement drainage structure comprises a plurality of transverse drainage ditches arranged in a pavement cushion of the main tunnel or on the top of an invert filling layer and a longitudinal drainage ditch arranged on the low-lying side of the main tunnel, the plurality of the transverse drainage ditches are all connected to the longitudinal drainage ditch, the longitudinal drainage ditch of the tunnel portal section drainage structure is connected to an inspection well of the central ditch through a transverse aqueduct C, and the longitudinal drainage ditch of the tunnel body section drainage structure is connected to the transverse water diversion ditch.

Further, a permeable pipe or a 270° perforated drainage pipe is buried in both the transverse drainage ditch and the longitudinal drainage ditch, and the remaining space in the transverse drainage ditch and the longitudinal drainage ditch is filled with washed gravel.

Further, the transverse water diversion ditch is arranged in a transverse tube and below a pavement structure at the junction of the main tunnel and the transverse tube, the transverse water diversion ditch is connected to the service tunnel drainage channel through a gallery-type inspection well, and a wellhead of the gallery-type inspection well is arranged in the transverse tube.

Further, the bottom of the gallery-type inspection well is provided with a desilting space.

Further, the upper portion of the inspection well of the central ditch and the gallery-type inspection well are both provided with thermal insulation materials with a thickness of not less than 30 cm.

Further, the side clear water ditch and the side sewage ditch B share an integral cover plate, the ditch body of the side sewage ditch B has a prefabricated reinforced concrete structure, the integral cover plate located on the upper portion of the side sewage ditch B is partially provided with water collection grooves and drainage holes, one side of the side clear water ditch shares a prefabricated side wall with a cable trench, the other side shares the side wall with the side sewage ditch B, and the upper portion of the side clear water ditch is provided with thermal insulation materials.

The beneficial effects of the present invention are:

1. separation and discharge treatment of clear water and sewage during tunnel construction and operation is realized, and high environmental requirements are met; 2. a drainage structure is separately arranged at a tunnel portal section and a tunnel body section, the thermal insulation requirements of drainage in cold regions are met, and groundwater is effectively prevented from seeping into the tunnel to cause freezing disasters; 3. a service tunnel is used to assist in enhancing drainage capacity of a main tunnel, and the ultra-large water discharge of the ultra-long tunnel is realized.

In the figures: 1—main tunnel, 2—service tunnel, 3—transverse tube, 4—tunnel portal section of main tunnel, 5—tunnel body section of main tunnel, 6—central ditch, 7—side sewage ditch A, 8—side sewage ditch B, 9—side clear water ditch, 10—transverse water diversion ditch, 11—service tunnel drainage channel, 12—gallery-type inspection well, 13—water drop well, 14—out-tunnel clear water ditch, 15—out-tunnel deep-buried ditch, 16—out-tunnel sewage ditch, 17—clear water tank, 18—annular drainage pipe, 19—longitudinal drainage pipe, 20—transverse aqueduct A, 21—transverse drainage ditch, 22—longitudinal drainage ditch, 23—transverse aqueduct B, 24—inspection well of central ditch, 25—transverse aqueduct C, 26—cable trench.

DETAILED DESCRIPTION OF THE EMBODIMENTS

The expressway tunnel to be designed for construction, is an ultra-long tunnel of 22 km long with a maximum burial depth of about 1150 m, and is designed according to the technical standard of bidirectional and four lane expressway of 100 km/h. The tunnel section traverses Tianger mountain, with low sides on both sides, high in the middle and large terrain undulations, and passes through a plurality of geomorphological units, mainly comprising alpine glacier landform area, alluvial-proluvial erosion gully landform area, piedmont slope accumulation landform area and tectonic denudation mid-alpine landform area, with an altitude of 2,620 m-4,234 m, and relative height difference of 1,600 m, basically no vegetation above 3,500 m above sea level, and covered with snow locally throughout the year. The main types of groundwater are mainly loose rock pore water, bedrock weathered fissure water and structural fissure water, and the hydrogeological conditions are more complicated. Considering factors such as disaster prevention and rescue, topographic and geological characteristics, construction period, inclined well or vertical well setting, construction risk and other factors during the tunnel operation period, it is recommended to adopt the methods of main tunnel drilling and blasting method and TBM service tunnel three-tunnel scheme.

Figure 2:
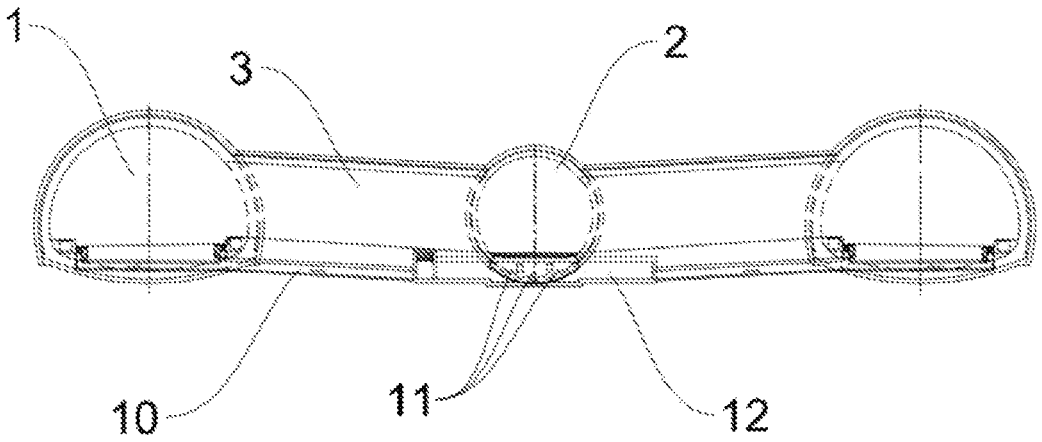
FIG. 2 shows a cross-sectional diagram of a main tunnel, a service tunnel, and a transverse water diversion ditch of the present invention.
Figure 5:
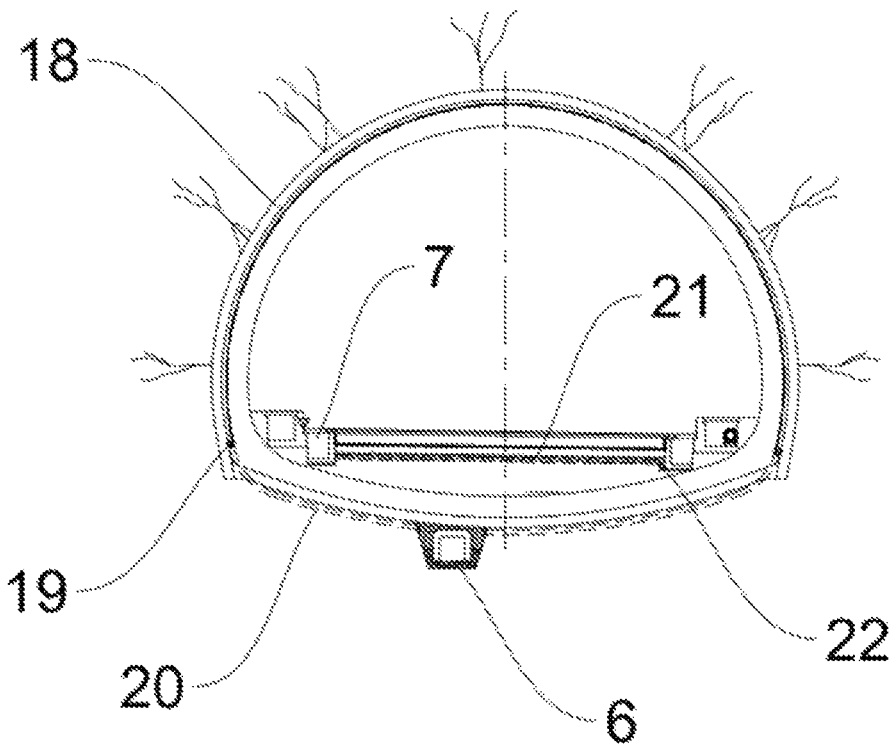
FIG. 5 shows a drainage layout diagram of a tunnel portal section of a main tunnel of the present invention.
Figure 7:
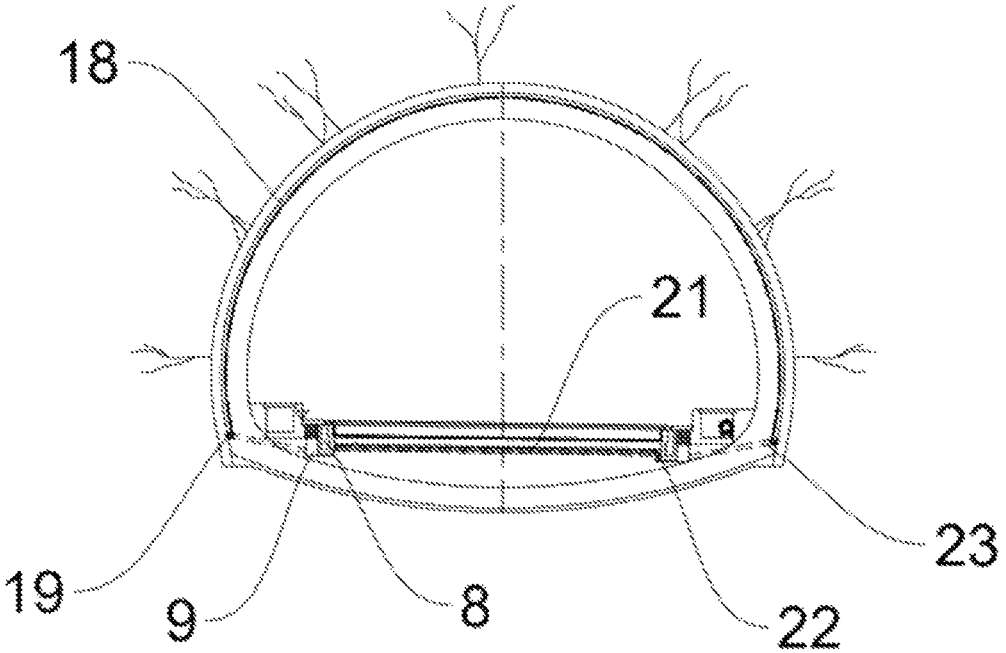
FIG. 7 shows a drainage layout diagram of a tunnel body section of a main tunnel of the present invention.

As shown in FIGS. 2, 5 and 7, the above-mentioned ultra-long tunnel comprises two main tunnels 1 and a service tunnel 2 between the two main tunnels 1. A tunnel lining drainage in the main tunnel 1 is collected to a longitudinal drainage pipe 19 at the bottom of the wall back through a permeable annular drainage pipe 18. The main tunnels 1 and the service tunnel 2 are connected by a plurality of transverse tubes 3, and the transverse tube 3 comprises transverse pedestrian tubes and transverse traffic tubes. The service tunnel 2 is arranged in parallel between the two main tunnels 1, and the elevation thereof is lower than that of the main tunnel 1, with a height difference of about 1 m. The service tunnel 2 also has the functions of auxiliary construction, disaster prevention and rescue, and auxiliary drainage.

The annular drainage pipe 18 comprises φ50 mm flexible permeable pipes evenly laid along the initial support surface, and 1-3 φ100 semicircular drainage pipes centrally laid on the surface of the surrounding rock at the concentrated seepage area depending on the water volume. The longitudinal drainage pipe 19 adopts φ100 mm double-wall perforated corrugated pipes, which are arranged along the side wall of the tunnel, one on each side, and the slope thereof is consistent with the longitudinal slope of the tunnel. The annular drainage pipe 18 and the longitudinal drainage pipe 19 are connected by means of a three-way connection.

Figure 1:
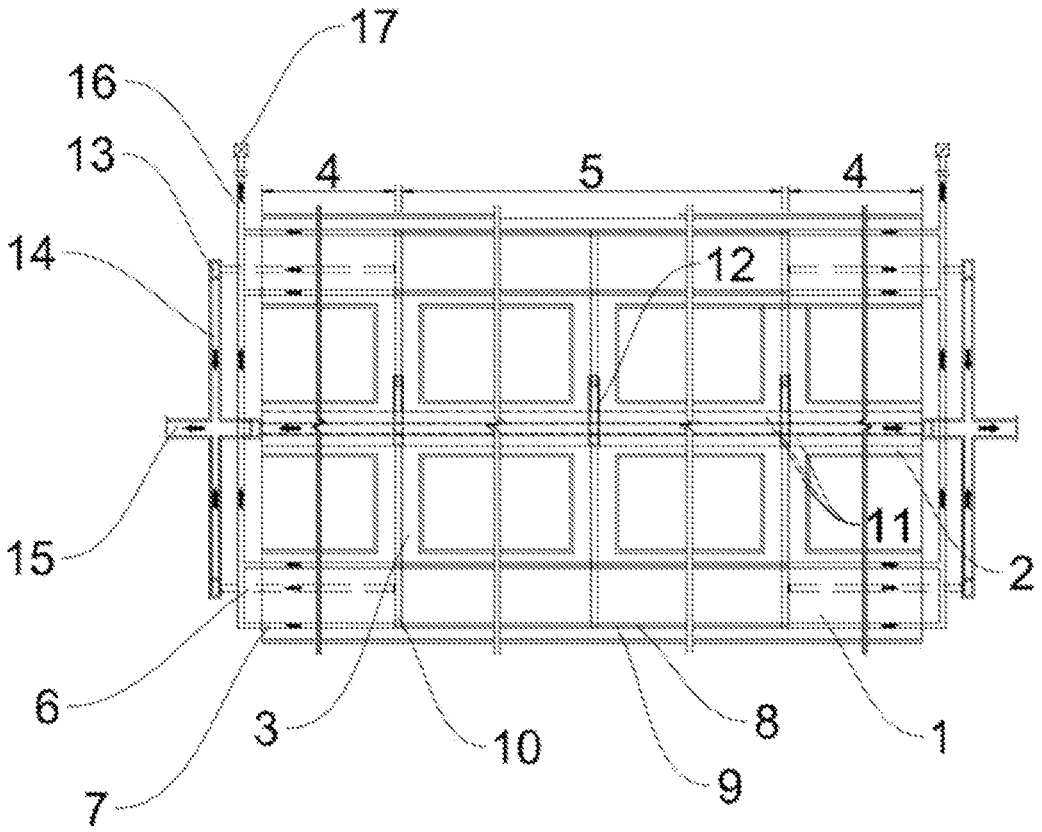
FIG. 1 shows a plan layout diagram of a sewage disposal, separation and drainage structure of the present invention.

As shown in FIGS. 1-2, the above-mentioned ultra-long tunnel sewage disposal, separation and drainage structure comprises a tunnel portal section drainage structure and a tunnel body section drainage structure arranged on the inside of the main tunnel 1 and an out-tunnel clear water ditch 14, an out-tunnel deep-buried ditch 15, an out-tunnel sewage ditch 16 and a clear water tank 17 arranged on the outside of the main tunnel 1. The tunnel portal section 4 of the main tunnel and the tunnel body section 5 of the main tunnel are demarcated at a suitable position corresponding to the transverse tube 3, and the selection of the demarcation position is determined according to the length of the tunnel entrance and exit that needs to be insulated and fortified. When the length of the tunnel portal section 4 of the main tunnel is greater than the length to be fortified, the nearest transverse tube 3 that is greater than the length to be fortified is selected for demarcation.

Figure 6:
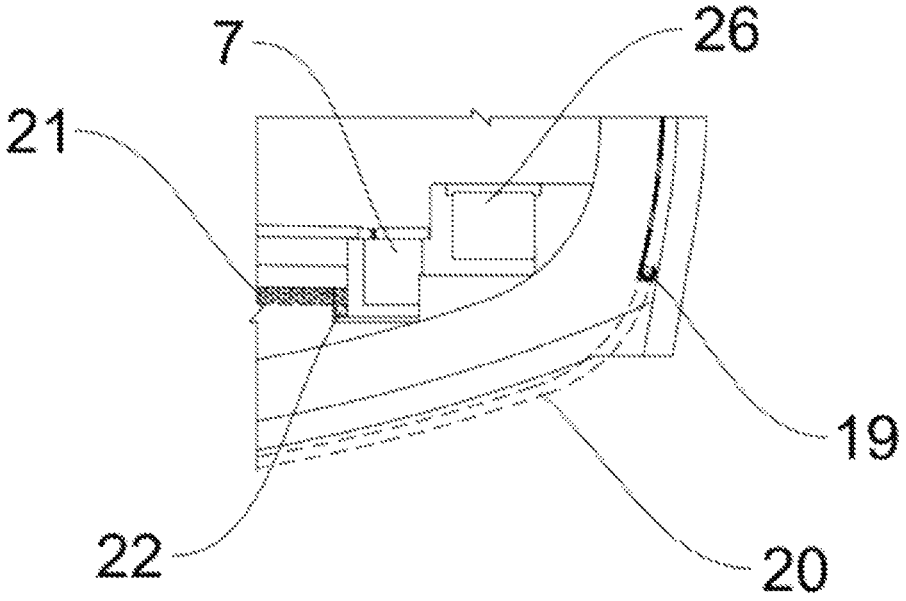
FIG. 6 shows a partial enlarged diagram of a side sewage ditch A of the present invention.

As shown in FIGS. 1, 5 and 6, the tunnel portal section drainage structure comprises a central ditch 6 configured to drain clear water and a side sewage ditch A 7 configured to drain sewage. The central ditch 6 is deeply buried in the position, lower than the freezing depth, of the tunnel portal section 4 of the main tunnel. One end of the central ditch 6 at the inside of the main tunnel 1 is blocked, and the other end at the outside of the main tunnel 1 is connected to the out-tunnel clear water ditch 14 through a water drop well 13. A longitudinal drainage pipe 19 in a tunnel lining of the tunnel portal section 4 of the main tunnel is connected to the central ditch 6 through a transverse aqueduct A 20, and the transverse aqueduct A 20 is arranged at the bottom of an invert. The side sewage ditches A 7 are arranged on both sides of the tunnel portal section 4 of the main tunnel.

Figure 8:
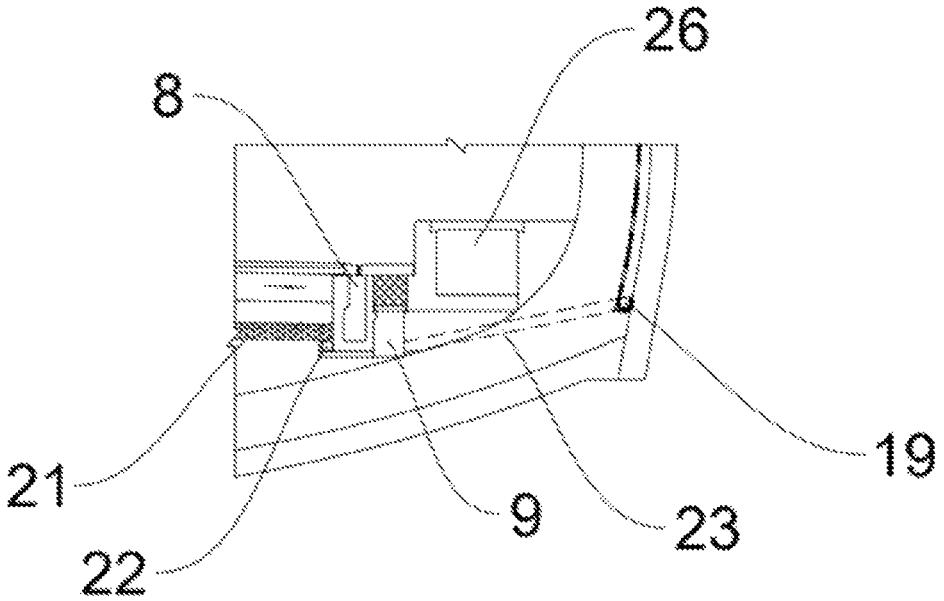
FIG. 8 shows a partial enlarged diagram of a side clear water ditch and a side sewage ditch B of the present invention.
Figure 9:
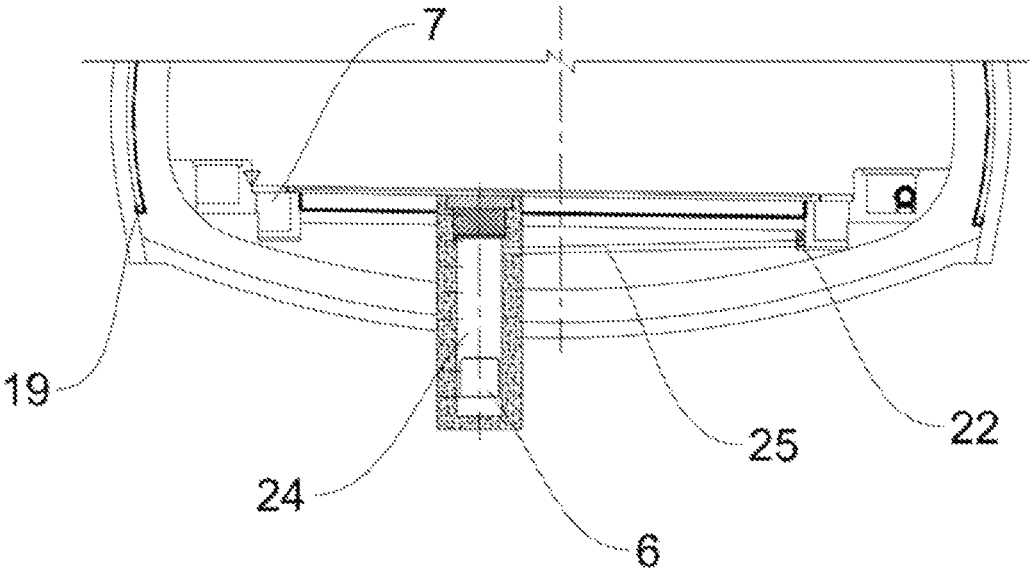
FIG. 9 shows a partial enlarged diagram of an inspection well of a central ditch of the present invention.

As shown in FIGS. 1, 7, and 8, the tunnel body section drainage structure comprises a side clear water ditch 9 configured to drain clear water and a side sewage ditch B 8 configured to drain sewage, and the side clear water ditches 8 and the side sewage ditches B 8 are arranged on both sides of the tunnel body section 5 of the main tunnel. The side clear water ditch 9 and the side sewage ditch B 8 share an integral cover plate, the ditch body of the side sewage ditch B 8 has a prefabricated reinforced concrete structure, the integral cover plate located on the upper portion of the side sewage ditch B 8 is partially provided with water collection grooves and drainage holes. One side of the side clear water ditch 9 shares a prefabricated side wall with a cable trench 26, the other side shares the side wall with the side sewage ditch B 8, and the upper portion of the side clear water ditch 9 is provided with thermal insulation materials. The side clear water ditch 9 is connected to a service tunnel drainage channel 11 through a transverse water diversion ditch 10, and the out-tunnel clear water ditch 14 and the service tunnel drainage channel 11 merge into the out-tunnel deep-buried ditch 15. The longitudinal drainage pipe 19 in the tunnel lining of the tunnel body section 5 of the main tunnel is connected to the side clear water ditch 9 through a transverse aqueduct B 23, and the side sewage ditches B 8 on both sides of the tunnel body section 5 of the main tunnel are longitudinally connected to the side sewage ditches A 7 on both sides of the tunnel portal section 4 of the main tunnel and merge into the clear water tank 17 through the out-tunnel sewage ditch 16.

As shown in FIGS. 4-9, both the tunnel portal section drainage structure and the tunnel body section drainage structure further comprise a pavement drainage structure. The pavement drainage structure comprises a plurality of transverse drainage ditches 21 arranged in a pavement cushion of the main tunnel or on the top of an invert filling layer and a longitudinal drainage ditch 22 arranged on the low-lying side of the main tunnel 1. The plurality of the transverse drainage ditches 21 are all connected to the longitudinal drainage ditch 22, the longitudinal drainage ditch 22 of the tunnel portal section drainage structure is connected to an inspection well 24 of the central ditch through a transverse aqueduct C 25, and the longitudinal drainage ditch 22 of the tunnel body section drainage structure is connected to the transverse water diversion ditch 10. The inspection well 24 of the central ditch is connected to the transverse aqueduct C 25 on the low-lying side close to the main tunnel 1, and an escalator reinforcement is arranged on the well wall of the other side.

A permeable pipe or a 270° perforated drainage pipe is buried in both the transverse drainage ditch 21 and the longitudinal drainage ditch 22, and the remaining space in the transverse drainage ditch 21 and the longitudinal drainage ditch 22 is filled with washed gravel. During construction, the 270° perforated drainage pipe can be selected as a φ100 mm corrugated pipe, the ditch is filled with 1-2 cm washed gravel, and the longitudinal drainage ditch 22 in a water-rich area can be arranged with two permeable pipes or 270° perforated drainage pipes.

Figure 3:
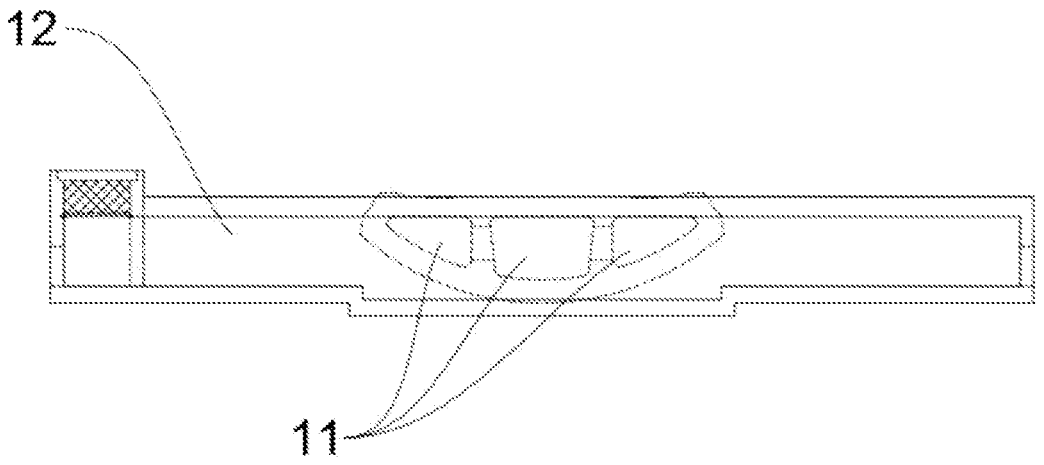
FIG. 3 shows a cross-sectional diagram of a gallery-type inspection well of the present invention.
Figure 4:
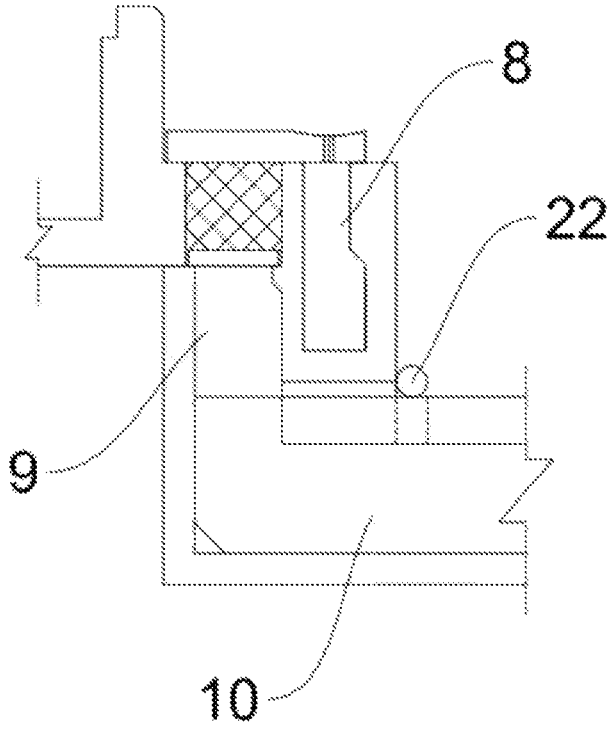
FIG. 4 shows a partial enlarged diagram of the position where a transverse water diversion ditch is connected to a side clear water ditch and a longitudinal drainage ditch of the present invention.

As shown in FIGS. 2-4, the transverse water diversion ditch 10 is arranged in a transverse tube 3 and below a pavement structure at the junction of the main tunnel 1 and the transverse tube 3, and the longitudinal spacing thereof is determined by the appropriate transverse tube 3 selected according to the water volume. The transverse water diversion ditch 10 is connected to the service tunnel drainage channel 11 through a gallery-type inspection well 12, and a wellhead of the gallery-type inspection well 12 is arranged in the transverse tube 3. The bottom of the gallery-type inspection well 12 is provided with a desilting space, which makes the gallery-type inspection well 12 double as a desilting well.

The upper portion of the inspection well 24 of the central ditch and the gallery-type inspection well 12 are both provided with thermal insulation materials with a thickness of not less than 30 cm, which plays a role in thermal insulation.

For tunnel drainage in cold regions, it is advisable to set up a deep-buried central ditch 6 in the areas where groundwater may freeze. Generally speaking, the portal of the tunnel is located in the region with low temperature, which is easy to freeze, therefore, the central ditch 6 buried deep within a certain range of the tunnel portal section can play a role in cold protection and heat preservation. But for the extra-long and ultra-long tunnels, the tunnel body section is relatively less affected by low temperature, and the deep-buried central ditch 6 is difficult to construct and inconvenient to maintain, so it is not suitable to deep-bury the central ditch 6 in the tunnel body section. The present invention arranges a drainage structure at the tunnel portal section and the tunnel body section separately, meeting the thermal insulation requirements of drainage in cold regions, thereby effectively preventing groundwater from seeping into the tunnel to cause freezing disasters.

The extra-long and ultra-long tunnels span a large geological area and the overall water volume of the tunnels is large, which requires the tunnel to have a strong drainage capacity. The drainage of the main tunnel 1 is limited by a section and a longitudinal slope, and the drainage capacity is thus limited. The service tunnel 2 with parallel adit is used to assist the drainage of the main tunnel 1, so that a larger water passage space can be set, and the height difference between the service tunnel 2 and the main tunnel 1 can be used to increase the hydraulic slope, and the drainage capacity of the main tunnel 1 therefore can be enhanced and the utility of the service tunnel 2 can be better used.

Specifically, in the above-mentioned ultra-long tunnel sewage disposal, separation and drainage structure, the flow direction of the clear water is as follows.

At the tunnel portal section 4 of the main tunnel, the drainage of the tunnel lining is collected to the longitudinal drainage pipe 19 at the bottom of the wall back through the permeable annular drainage pipe 18, and then drained into the central ditch 6 through the transverse aqueduct A 20; and the drainage of the pavement structure is collected through the transverse drainage ditch 21 set on the top of a pavement cushion or a invert filling layer, collected to the longitudinal drainage ditch 22 and drained into the central ditch 6 through the transverse aqueduct C 25.

At the tunnel body section 5 of the main tunnel, the drainage of the tunnel lining is collected to the longitudinal drainage pipe 19 at the bottom of the wall back through the permeable annular drainage pipe 18, drained into the side clear water ditch 9 through the transverse aqueduct B 23 and then into the service tunnel drainage channel 11 through the transverse water diversion ditch 10; and the drainage of the pavement structure is collected through the transverse drainage ditch 21 set on the top of a pavement cushion or an invert filling layer, collected to the longitudinal drainage ditch 22 and drained into the service tunnel drainage channel 11 through the transverse water diversion ditch 10.

The clear water collected in the central ditch 6 flows into the out-tunnel clear water ditch 14 through the water drop well 13 and is collected with the clear water in the service tunnel drainage channel 11 to the out-tunnel deep-buried ditch 15 for centralized drainage.

Specifically, in the above-mentioned ultra-long tunnel sewage disposal, separation and drainage structure, the flow direction of the sewage is as follows.

In the main tunnel 1, after flowing into the out-tunnel sewage ditch 16 through the side sewage ditch A 7 and the side sewage ditch B8, the sewage is introduced into the clear water tank 17 for treatment and then drained or reused. The clear water tank 17 comprises but is not limited to a sedimentation tank, a water catchment tank, a filter tank and a reaction tank.

The sewage during the construction of the service tunnel 2 needs to be collected at a tunnel face and pumped to the side sewage ditch A 7 or the side sewage ditch B 8 in the main tunnel 1 for drainage; the service tunnel 2 has very little sewage during operation, which can be drained out of the tunnel directly through small side ditches on the road surface.

Of course, the above are only preferred embodiments of the present invention and are not intended to limit the scope of application of the present invention. Therefore, any equivalent changes made in the principle of the present invention should be considered to be within the protection scope of the present invention.

The invention claimed is:

1. A tunnel sewage disposal, separation and drainage structure suitable for cold regions, comprising: a tunnel portal section drainage structure and a tunnel body section drainage structure arranged on the inside of a main tunnel and an out-tunnel clean water ditch, an out-tunnel buried ditch, an out-tunnel sewage ditch and a clean water tank arranged on the outside of the main tunnel;

wherein the tunnel portal section drainage structure comprises a central ditch configured to drain clean water and first side sewage ditches configured to drain sewage; wherein the central ditch is buried in the position, lower than the freezing depth, of the tunnel portal section of the main tunnel; one end of the central ditch at the inside of the main tunnel is blocked, and the other end at the outside of the main tunnel is connected to the out-tunnel clean water ditch through a water drop well; a longitudinal drainage pipe in a tunnel lining of the tunnel portal section of the main tunnel is connected to the central ditch through a first transverse aqueduct, the first transverse aqueduct is arranged at the bottom of an invert, and the first side sewage ditches are arranged on both sides of the tunnel portal section of the main tunnel;

wherein the tunnel body section drainage structure comprises side clean water ditches configured to drain the clean water and second side sewage ditches configured to drain the sewage; wherein the side clean water ditches and the second side sewage ditches are arranged on both sides of the tunnel body section of the main tunnel, the side clean water ditch is connected to a service tunnel drainage channel through a transverse water diversion ditch, the out-tunnel clean water ditch and the service tunnel drainage channel merge into the out-tunnel buried ditch, the longitudinal drainage pipe in the tunnel lining of the tunnel body section of the main tunnel is connected to the side clean water ditch through a second transverse aqueduct, and the second side sewage ditches on both sides of the tunnel body section of the main tunnel are longitudinally connected to the first side sewage ditches on both sides of the tunnel portal section of the main tunnel and merge into the clean water tank through the out-tunnel sewage ditch.

2. The tunnel sewage disposal, separation and drainage structure suitable for cold regions according to claim 1, wherein both the tunnel portal section drainage structure and the tunnel body section drainage structure further comprise a pavement drainage structure; the pavement drainage structure comprises a plurality of transverse drainage ditches arranged in a pavement cushion of the main tunnel or on the top of an invert filling layer and a longitudinal drainage ditch arranged on the low-lying side of the main tunnel, the plurality of the transverse drainage ditches are all connected to the longitudinal drainage ditch, the longitudinal drainage ditch of the tunnel portal section drainage structure is connected to an inspection well of the central ditch through a third transverse aqueduct, and the longitudinal drainage ditch of the tunnel body section drainage structure is connected to the transverse water diversion ditch.

3. The tunnel sewage disposal, separation and drainage structure suitable for cold regions according to claim 2, wherein a permeable pipe or a 270° perforated drainage pipe is buried in both the transverse drainage ditch and the longitudinal drainage ditch, and the remaining space in the transverse drainage ditch and the longitudinal drainage ditch is filled with washed gravel.

4. The tunnel sewage disposal, separation and drainage structure suitable for cold regions according to claim 2, wherein the transverse water diversion ditch is arranged in a transverse tube and below a pavement structure at the junction of the main tunnel and the transverse tube, the transverse water diversion ditch is connected to the service tunnel drainage channel through a second inspection well, and a wellhead of the second inspection well is arranged in the transverse tube.

5. The tunnel sewage disposal, separation and drainage structure suitable for cold regions according to claim 4, wherein the bottom of the second inspection well is provided with a desilting space.

6. The tunnel sewage disposal, separation and drainage structure suitable for cold regions according to claim 4, wherein the upper portion of the inspection well of the central ditch and the second inspection well are both provided with thermal insulation materials with a thickness of not less than 30 cm.

7. The tunnel sewage disposal, separation and drainage structure suitable for cold regions according to claim 1, wherein the side clean water ditch and the second side sewage ditch share an integral cover plate, the ditch body of the second side sewage ditch has a prefabricated reinforced concrete structure, the integral cover plate located on the upper portion of the second side sewage ditch is partially provided with water collection grooves and drainage holes, one side of the side clean water ditch shares a prefabricated side wall with a cable trench, the other side shares the side wall with the side sewage ditch B, and the upper portion of the side clean water ditch is provided with thermal insulation materials.

8. The tunnel sewage disposal separation and drainage structure suitable for cold regions according to claim 1, wherein the first transverse aqueduct and the second transverse aqueduct are perpendicular to a longitudinal direction of the tunnel.

9. The tunnel sewage disposal separation and drainage structure suitable for cold regions according to claim 2, wherein the first transverse aqueduct, the second transverse aqueduct, and the third transverse aqueduct are perpendicular to a longitudinal direction of the tunnel.

* * * * *